US012644448B2

(12) United States Patent
Yin et al.

(10) Patent No.: US 12,644,448 B2
(45) Date of Patent: Jun. 2, 2026

(54) FLOW RATE DISTRIBUTION METHOD AND APPARATUS, AND OPERATION MACHINE

(71) Applicant: SANY HEAVY MACHINERY LIMITED, Jiangsu (CN)

(72) Inventors: Shunkuan Yin, Jiangsu (CN); Zefeng Wang, Jiangsu (CN); Jianpeng Shi, Jiangsu (CN)

(73) Assignee: SANY HEAVY MACHINERY LIMITED, Jiangsu (CN)

( * ) Notice: Subject to any disclaimer, the term of this patent is extended or adjusted under 35 U.S.C. 154(b) by 95 days.

(21) Appl. No.: 18/723,395

(22) PCT Filed: Mar. 13, 2023

(86) PCT No.: PCT/CN2023/081093
§ 371 (c)(1),
(2) Date: Jun. 21, 2024

(87) PCT Pub. No.: WO2023/174211
PCT Pub. Date: Sep. 21, 2023

(65) Prior Publication Data

US 2025/0052237 A1 Feb. 13, 2025

(30) Foreign Application Priority Data

Mar. 16, 2022 (CN) ..... 202210261853.5

(51) Int. Cl.
*F04B 49/00* (2006.01)
*F04B 49/06* (2006.01)

(52) U.S. Cl.
CPC ..... *F04B 49/002* (2013.01); *F04B 49/065* (2013.01)

(58) Field of Classification Search
CPC ..... F04B 49/002; F04B 49/065
See application file for complete search history.

(56) References Cited

U.S. PATENT DOCUMENTS

2012/0201640 A1 8/2012 Jessen et al.
2014/0322045 A1 10/2014 Sakamoto
(Continued)

FOREIGN PATENT DOCUMENTS

AU 2015100687 A4 6/2015
CN 102575453 A 7/2012
(Continued)

OTHER PUBLICATIONS

CN Office Action dated May 4, 2023 as received in Application No. 202210261853.5.
(Continued)

*Primary Examiner* — Hunter B Lonsberry
*Assistant Examiner* — Besufekad Lemma Tessema
(74) *Attorney, Agent, or Firm* — Maschoff Brennan

(57) ABSTRACT

A flow rate distribution method and apparatus and a work machine. The flow rate distribution method includes: acquiring a current actual displacement of each working element on a work machine; performing time integration on a current speed of each working element to obtain a current target displacement of each working element; determining a current displacement deviation of each working element based on the current actual displacement of each working element and the current target displacement of each working element; and distributing a current pump control flow rate of the work machine based on the current displacement deviation of each working element. According to the flow rate distribution method, when a plurality of working elements of a work machine operate, a current pump control flow rate can be accurately distributed.

14 Claims, 2 Drawing Sheets

(56) References Cited

U.S. PATENT DOCUMENTS

| | | | | |
|---|---|---|---|---|
| 2016/0040398 | A1 | 2/2016 | Kitajima et al. | |
| 2016/0319848 | A1 | 11/2016 | Tanaka et al. | |
| 2018/0119384 | A1* | 5/2018 | Imaizumi | E02F 9/265 |
| 2021/0002868 | A1 | 1/2021 | Kumagai et al. | |
| 2022/0170234 | A1 | 6/2022 | Nakano et al. | |
| 2022/0195704 | A1* | 6/2022 | Shimizu | E02F 9/2079 |
| 2024/0003122 | A1 | 1/2024 | Li et al. | |

FOREIGN PATENT DOCUMENTS

| | | | | | |
|---|---|---|---|---|---|
| CN | 102588358 | A | | 7/2012 | |
| CN | 103711598 | A | | 4/2014 | |
| CN | 104011301 | A | | 8/2014 | |
| CN | 104564634 | A | | 4/2015 | |
| CN | 105848989 | A | | 8/2016 | |
| CN | 107882103 | A | | 4/2018 | |
| CN | 108468662 | A | | 8/2018 | |
| CN | 110616770 | A | * | 12/2019 | E02F 9/2221 |
| CN | 111608977 | A | | 9/2020 | |
| CN | 111757964 | A | | 10/2020 | |
| CN | 112901570 | A | | 6/2021 | |
| CN | 112943751 | A | | 6/2021 | |
| CN | 112975983 | A | | 6/2021 | |
| CN | 113454293 | A | | 9/2021 | |
| CN | 113969909 | A | * | 1/2022 | E04G 21/04 |
| CN | 114688004 | A | | 7/2022 | |
| JP | H10-18339 | A | | 1/1998 | |
| JP | 2021132560 | A | * | 9/2021 | A01B 63/118 |
| TW | M505546 | U | | 7/2015 | |
| WO | WO-2015025985 | A1 | * | 2/2015 | E02F 3/437 |

OTHER PUBLICATIONS

CN Decision to Grant Dated Oct. 7, 2023 as received in Application No. 202210261853.5.

* cited by examiner

FLOW RATE DISTRIBUTION METHOD AND APPARATUS, AND OPERATION MACHINE

TECHNICAL FIELD

This application relates to the technical field of work machine, and in particular, to a flow rate distribution method and apparatus and a work machine.

BACKGROUND

When each working element of a work machine works, a corresponding work flow rate may be provided to each working element of the work machine by controlling a lever stroke of the work machine to complete work.

However, a plurality of working elements of the work machine usually work simultaneously. For a work flow rate of each working element, a pump control flow rate of the work machine is distributed according to a lever stroke of a manual operation by an operator. As a result, work flow rates distributed to some working elements may be insufficient, and a work requirement fails to be met.

SUMMARY

This application provides a flow rate distribution method and apparatus and a work machine, to resolve a deficiency in the related art that a flow rate cannot be accurately distributed when a plurality of working elements work.

This application provides a flow rate distribution method includes: acquiring current actual displacements of a plurality of working elements on a work machine; performing time integration on a current speed of each working element to obtain a current target displacement of each working element; determining a current displacement deviation of each working element based on the current actual displacement of each working element and the current target displacement of each working element; and distributing a current pump control flow rate of the work machine based on the current displacement deviation of each working element.

According to the flow rate distribution method provided in this application, the step of distributing a current pump control flow rate of the work machine based on the current displacement deviation of each working element includes: determining a flow rate distribution ratio of each working element based on the current displacement deviation of each working element and an oil cylinder cross-sectional area of each working element; and distributing the current pump control flow rate of the work machine based on the flow rate distribution ratio of each working element.

According to the flow rate distribution method provided in this application, the step of determining a flow rate distribution ratio of each working element based on the current displacement deviation of each working element and an oil cylinder cross-sectional area of each working element includes: determining a current required flow rate of each working element based on the current displacement deviation of each working element and the oil cylinder cross-sectional area of each working element, where the current required flow rate of each working element is used for representing a flow rate required for each working element to reach the current target displacement; and determining the flow rate distribution ratio of each working element based on the current required flow rate of each working element.

According to the flow rate distribution method provided in this application, the current speed of each working element is determined based on the following process:

determining the current speed of each working element based on a current lever stroke of the work machine and a preset lever stroke-speed curve of each working element, where the preset lever stroke-speed curve of each working element is used for representing a relationship between a current lever stroke and a current speed of a corresponding working element.

According to the flow rate distribution method provided in this application, a process of distributing the current pump control flow rate of the work machine further includes: acquiring an oil cylinder pressure of each working element in real time, and when an oil cylinder pressure of any working element exceeds a preset pressure range, adjusting a valve opening degree corresponding to this working element, until an oil cylinder pressure corresponding thereto becomes within the preset pressure range.

According to the flow rate distribution method provided in this application, the current actual displacement of each working element is determined based on a posture parameter acquired by a posture sensor on each working element.

This application further provides a flow rate distribution apparatus, including: an acquisition unit, configured to obtain current actual displacements of a plurality of working elements on a work machine; an integration unit, configured to perform time integration on a current speed of each working element to obtain a current target displacement of each working element; a determination unit, configured to determine a current displacement deviation of each working element based on the current actual displacement of each working element and the current target displacement of each working element; and a distribution unit, configured to distribute a current pump control flow rate of the work machine based on the current displacement deviation of each working element.

This application further provides a work machine, including the foregoing flow rate distribution apparatus.

This application further provides an electronic device, including: a memory, a processor, and a computer program stored in the memory and configured to be executed by the processor, where the processor, when executing the computer program, performs the foregoing flow rate distribution method.

This application further provides a non-transitory computer-readable storage medium, having a computer program stored therein, where the computer program, when being executed by a processor, enables the processor to perform the foregoing flow rate distribution method.

This application further provides a computer program product, including a computer program, where the computer program, when being executed by a processor, enables the processor to perform the foregoing flow rate distribution method.

For the flow rate distribution method and apparatus and the work machine provided in this application, a current displacement deviation of each working element can be accurately determined based on a current actual displacement of each working element and a current target displacement of each working element, and a current pump control flow rate of the work machine can be accurately distributed in real time according to the current displacement deviation of each working element, to avoid a problem in a conventional method that a current pump control flow rate fails to be accurately distributed due to the dependence on manual control of a lever stroke by an operator.

BRIEF DESCRIPTION OF THE DRAWINGS

To describe the technical solutions in this application or the related art more clearly, the following briefly introduces the accompanying drawings required for describing the embodiments or the related art. Apparently, the accompanying drawings in the following description show some embodiments of this application, and a person of ordinary skill in the art may still derive other drawings from these accompanying drawings without creative efforts.

DETAILED DESCRIPTION OF THE EMBODIMENTS

To make the objectives, technical solutions, and advantages of this application clearer, the following clearly and completely describes the technical solutions in this application with reference to the accompanying drawings in this application. It is clear that the described embodiments are merely some rather than all of embodiments of this application. All other embodiments obtained by a person of ordinary skill in the art based on the embodiments of this application without creative efforts fall within the protection scope of this application.

When a single working element of a work machine works, a sufficient work flow rate may be supplied by adjusting a lever stroke to the corresponding working element to work. However, a plurality of working elements of the work machine usually work simultaneously. For a work flow rate of each working element, a pump control flow rate of the work machine is distributed according to a lever stroke of a manual operation by an operator. As a result, work flow rates distributed to some working elements may be insufficient, and a work requirement fails to be met.

Figure 1:
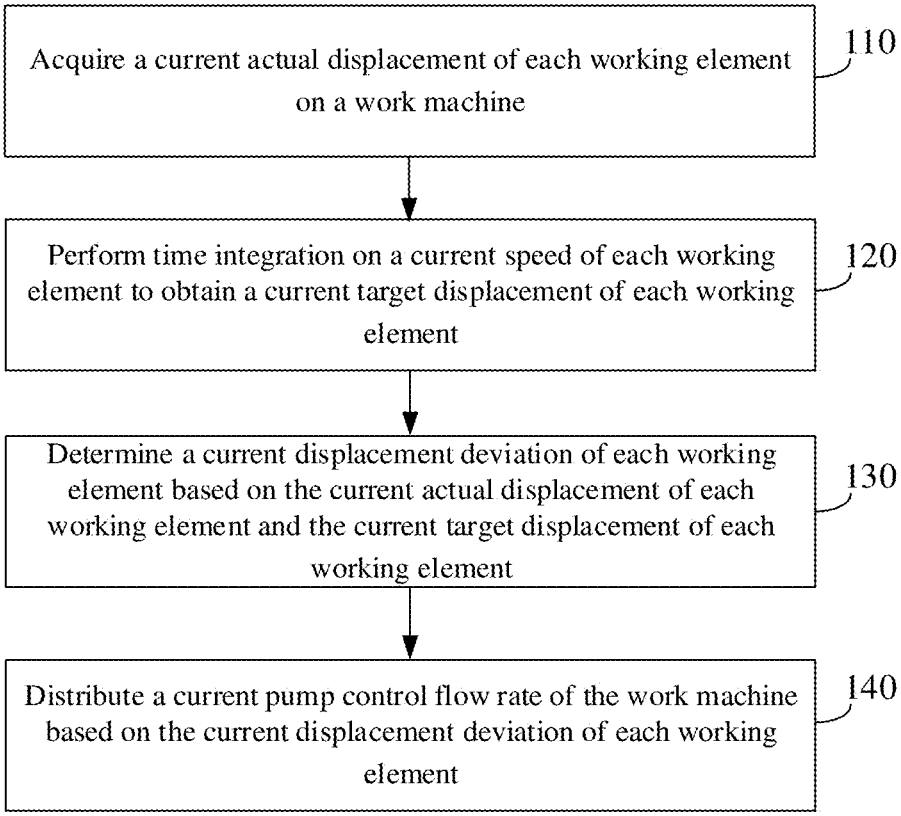
FIG. 1 is a schematic flowchart of a flow rate distribution method according to an embodiment of this application.

For this, this application provides a flow rate distribution method. FIG. 1 is a schematic flowchart of a flow rate distribution method according to an embodiment of this application. As shown in FIG. 1, the method includes the following steps.

Step 110: Obtain a current actual displacement of each working element on a work machine.

The work machine includes a plurality of working elements. The step of acquiring a current actual displacement of each working element on a work machine is to acquire respective current actual displacements of the plurality of working elements included in the work machine. The work machine may be, for example, a crane, an excavator, a loader, a pile driver, or another engineering machine, or may be, for example, a ladder truck, a fire engine, an agitating lorry, or another engineering vehicle. For example, when the work machine is an excavator, the plurality of working elements corresponding to the work machine may be a boom, a dipper handle, a bucket, and the like. Corresponding current actual displacements are a current actual displacement of the boom, a current actual displacement of the dipper handle, a current actual displacement of the bucket, and the like.

A posture sensor may be mounted on each working element, and the current actual displacement of each working element is acquired by a corresponding posture sensor. Alternatively, an angle change of each working element may be acquired by a corresponding posture sensor, and the current actual displacement of each working element is calculated according to the angle change and a size parameter of each working element. That is, the current actual displacement of each working element is determined based on the angle change of each working element and the size parameter of each working element. This is not specifically limited in this embodiment of this application.

Step 120: Perform time integration on a current speed of each working element to obtain a current target displacement of each working element.

Specifically, the current speed of each working element may be acquired by a speed sensor, or may be determined by a current lever stroke and a preset lever stroke-speed curve used for representing a relationship between a current lever stroke and the current speed.

After the current speed of each working element is obtained, time integration is performed on the current speed, so that the current target displacement of each working element may be obtained. The current target displacement is a theoretical value determined based on the current lever stroke. That is, after a lever stroke reaches a corresponding position at a current moment, a corresponding work flow rate may be provided to a corresponding work apparatus at the same moment, and the corresponding work apparatus at the same moment may reach a corresponding target displacement. However, in an actual process, after the lever stroke reaches the corresponding position, there may be a delay in the provided work flow rate, and after the corresponding work flow rate is provided, the work apparatus still cannot reach the target displacement at the same moment. Therefore, the current actual displacement of each working element usually lags behind the current target displacement. That is, there may be a deviation between the current actual displacement and the current target displacement.

If a conventional method is used to distribute a pump control flow rate (that is, a total flow rate) of the work machine through manual control of a lever stroke by an operator, work flow rates distributed to some work apparatuses may be insufficient, affecting a work progress.

For example, after the operator controls the lever stroke at a moment T, a sufficient work flow rate M in the pump control flow rate is distributed to a work apparatus A. The work flow rate M may enable the work apparatus A to reach a target position b from a current position a. However, the work apparatus A is actually at a position a' at the moment T, and lags behind the position a. That is, a distance between the position a' and the target position b is greater than a distance between the position a and the target position b. That is, a work flow rate for enabling the work apparatus A to move from the current position a to the target position b is less than a work flow rate for enabling the work apparatus A to move from the position a' to the target position b, and the work flow rate M fails to enable the work apparatus A to move from the position a' to the target position b. That is, the work flow rate distributed to the work apparatus A is insufficient in the conventional method.

Step 130: Determine a current displacement deviation of each working element based on the current actual displacement of each working element and the current target displacement of each working element.

Step 140: Distribute a current pump control flow rate of the work machine based on the current displacement deviation of each working element.

Specifically, the current displacement deviation is used for representing a deviation between the current actual displacement and the current target displacement. The current displacement deviation may be represented by a difference value between the current actual displacement and the current target displacement. That is, the current displacement deviation of each working element is obtained by calculating the difference value between the current actual displacement of each working element and the current target displacement of each working element. The current pump control flow rate is a maximum flow rate that the work machine can output currently. The flow rate is a total sum of work flow rates of all working elements.

When a deviation exists between the current actual displacement and the current target displacement, that is, the current displacement deviation is not 0, it indicates that a corresponding work flow rate in the current pump control flow rate of the work machine needs to be distributed to a corresponding work apparatus for the work apparatus to complete work.

When the current displacement deviation is larger, it indicates that a larger work flow rate in the current pump control flow rate needs to be distributed to a corresponding working element. When the current displacement deviation is smaller, it indicates that a smaller work flow rate in the current pump control flow rate needs to be distributed to the corresponding working element.

Figure 2:
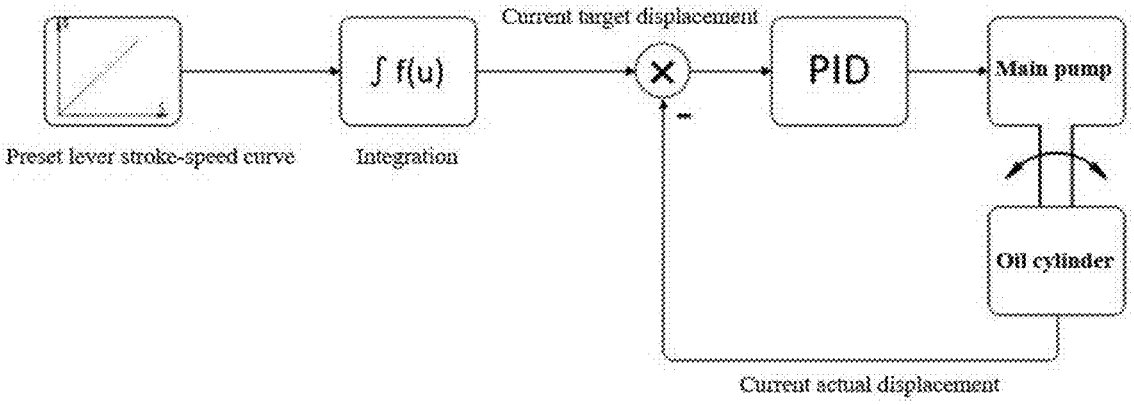
FIG. 2 is a schematic flowchart of a flow rate distribution method according to another embodiment of this application.

As shown in FIG. 2, the current speed of each working element is determined according to the preset lever stroke-speed curve, time integration is performed on the current speed to obtain the current target displacement of each working element, and then the current actual displacement of each working element is used as a displacement feedback. That is, a Proportion Integration Differentiation (PID) deviation is the current actual displacement—the current target displacement, and the current pump control flow rate is distributed based on the PID deviation.

For the flow rate distribution method provided in this embodiment of this application, a current displacement deviation of each working element can be accurately determined based on a current actual displacement of each working element and a current target displacement of each working element, and a current pump control flow rate of the work machine can be accurately distributed in real time according to the current displacement deviation of each working element, to avoid a problem in a conventional method that a current pump control flow rate fails to be accurately distributed due to the dependence on manual control of a lever stroke by an operator.

Based on the foregoing embodiment, the step of distributing a current pump control flow rate of the work machine based on the current displacement deviation of each working element includes: determining a flow rate distribution ratio of each working element based on the current displacement deviation of each working element and an oil cylinder cross-sectional area of each working element; and distributing the current pump control flow rate of the work machine based on the flow rate distribution ratio of each working element.

Specifically, the flow rate distribution ratio of each working element is used for representing a work flow rate required by each working element. When the flow rate distribution ratio is larger, it indicates that the work flow rate required by the working element is larger.

The work flow rate required by each working element is correlated to the current displacement deviation, and is further correlated to the oil cylinder cross-sectional area of each working element. When the current displacement deviation is larger and the oil cylinder cross-sectional area larger, it indicates that the work flow rate required by the corresponding working element is larger. When the current displacement deviation is smaller and the oil cylinder cross-sectional area is smaller, it indicates that the work flow rate required by the corresponding working element is smaller.

After the flow rate distribution ratio of each working element is determined, the current pump control flow rate of the work machine may be distributed according to each flow rate distribution ratio, so that the work flow rate distributed to each work apparatus can enable the work apparatus to reach the current target displacement. Optionally, the work flow rate of each working element=the flow rate distribution ratio of each working element×the current pump control flow rate.

Based on any foregoing embodiment, the step of determining a flow rate distribution ratio of each working element based on the current displacement deviation of each working element and an oil cylinder cross-sectional area of each working element includes: determining a current required flow rate of each working element based on the current displacement deviation of each working element and the oil cylinder cross-sectional area of each working element, where the current required flow rate of each working element is used for representing a flow rate required for each working element to reach the current target displacement; and determining the flow rate distribution ratio of each working element based on the current required flow rate of each working element.

Specifically, the current required flow rate of each working element is a flow rate required for each working element to reach the current target displacement from the current actual displacement. After the current displacement deviation of each working element and the oil cylinder cross-sectional area of each working element are determined, the current required flow rate of each working element may be obtained based on a product of the two.

After the current required flow rate of each working element is obtained, a ratio of the current required flow rate of each working element to a sum of all current required flow rates may be used as the flow rate distribution ratio. That is, when the current required flow rate is larger, the flow rate distribution ratio of the corresponding working element is larger.

An excavator is used as an example. The working elements of the excavator include a boom, a dipper handle, and a bucket. According to the method in the foregoing embodiment, a current displacement deviation $\Delta_{dipper\ handle}$ of the dipper handle and a current displacement deviation $\Delta_{bucket}$ of the bucket are obtained. In addition, an oil cylinder cross-sectional area of an oil inlet cavity corresponding to the dipper handle is $S_{dipper\ handle}$, and an oil cylinder cross-sectional area of an oil inlet cavity corresponding to the bucket is $S_{bucket}$. The maximum flow rate that the work machine can output currently is $P_0$ (that is, the current pump control flow rate is $P_0$). A work flow rate distributed to the dipper handle is $P_{dipper\ handle}=P_0\times(\Delta_{dipper\ handle}\times S_{dipper\ handle})/(\Delta_{dipper\ handle}\times S_{dipper\ handle}+\Delta_{bucket}\times S_{bucket})$, and a work flow rate distributed to the bucket $P_{bucket}=P_0\times(\Delta_{bucket}\times S_{bucket})/(\Delta_{dipper\ handle}\times S_{dipper\ handle}+\Delta_{bucket}\times S_{bucket})$.

Based on any foregoing embodiment, the current speed of each working element is determined based on the following process: determining the current speed of each working element based on a current lever stroke of the work machine and a preset lever stroke-speed curve of each working element, where the preset lever stroke-speed curve of each working element is used for representing a relationship between a current lever stroke and a current speed of a corresponding working element.

Specifically, the preset lever stroke-speed curve is used for representing the relationship between a current lever stroke and the current speed of the corresponding working element, and the current lever stroke is usually positively correlated to the current speed of the corresponding working element. That is, the preset lever stroke-speed curve is usually a positive correlation curve. The preset lever stroke-speed curve may be preset according to a pump valve characteristic of the work machine, and may further be set according to an actual case. This is not specifically limited in this embodiment of this application.

Because the preset lever stroke-speed curve is used for representing the relationship between a current lever stroke and the current speed of the corresponding working element, after the current lever stroke of the work machine is determined, the current speed of each working element may be accurately determined in combination with the relationship between a current lever stroke and the current speed in the preset lever stroke-speed curve, so that time integration may be performed on the current speed of each working element to obtain the current target displacement.

Based on any foregoing embodiment, a process of distributing the current pump control flow rate of the work machine further includes: acquiring an oil cylinder pressure of each working element in real time, and when an oil cylinder pressure of any working element exceeds a preset pressure range, adjusting a valve opening degree corresponding to this working element, until an oil cylinder pressure corresponding thereto becomes within the preset pressure range.

Specifically, in a process of distributing a current pump control flow rate of the work machine, the oil cylinder pressure of each working element may change. If the oil cylinder pressure exceeds the preset pressure range, air suction and pressure build-up may be caused, and as a result the work apparatus may stop, affecting a work progress.

To avoid air suction and pressure build-up, in the embodiments of this application, in a full process of distributing the current pump control flow rate of the work machine, the oil cylinder pressure of each working element is monitored. That is, the oil cylinder pressure of each working element is obtained in real time, and when the oil cylinder pressure of any working element exceeds the preset pressure range, it indicates a risk of causing air suction and pressure build-up. In this case, the valve opening degree corresponding to this working element is adjusted, to enable the oil cylinder pressure of the working element to fall back to the preset pressure range, thereby avoiding the problem that the work apparatus stops due to air suction and pressure build-up. For example, when the oil cylinder pressure of any working element is greater than a maximum value of the preset pressure range, it indicates that the oil cylinder pressure is excessively large, and pressure build-up tends to occur. In this case, the valve opening degree may be increased. When the oil cylinder pressure of any working element is less than a minimum value of the preset pressure range, it indicates that the oil cylinder pressure is excessively small, and air suction tends to occur. In this case, the valve opening degree may be decreased. The preset pressure range is a pressure range of an oil cylinder when the work apparatus can normally work, and may be specifically set according to an actual case. This is not specifically limited in the embodiments of this application.

Based on any foregoing embodiment, the current actual displacement of each working element is determined based on a posture parameter acquired by a posture sensor on each working element.

Specifically, the posture sensor is mounted on each working element, and the posture parameter acquired by the posture sensor may be the current actual displacement of each working element, or may be a current angle change of each working element. When the posture parameter is the current angle change of each working element, the current actual displacement of each working element may be calculated in combination with the size parameter (for example, a length) of each working element.

Figure 3:
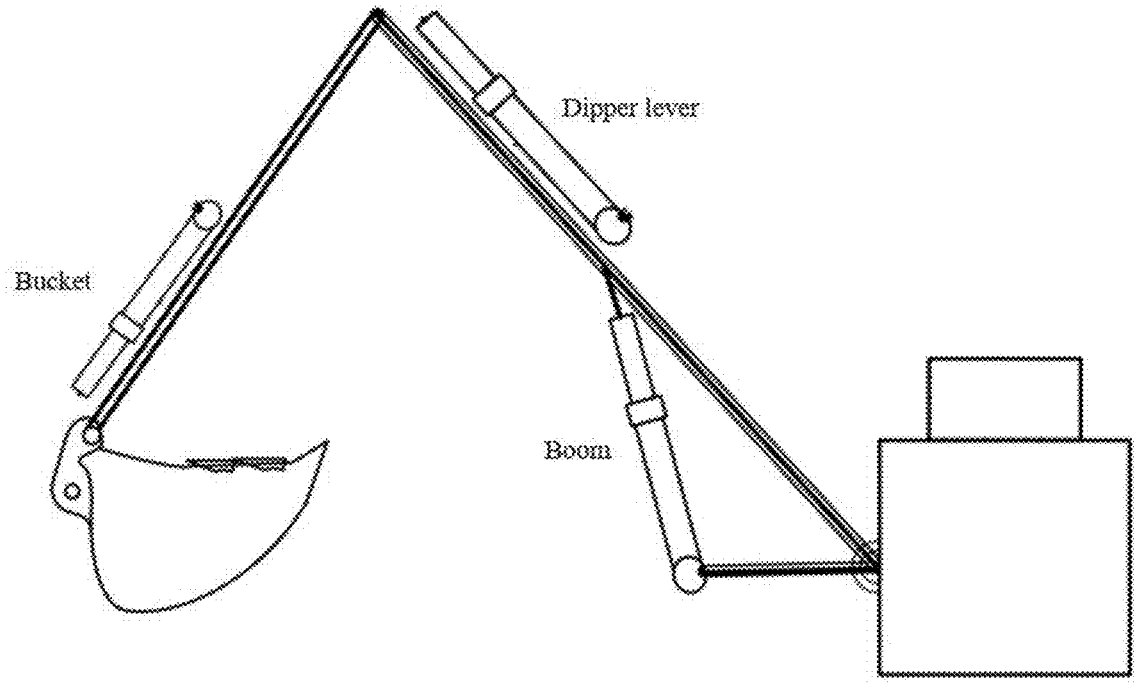
FIG. 3 is a schematic diagram of a distribution of posture sensors according to an embodiment of this application.

As shown in FIG. 3, the working elements of an excavator include a boom, a dipper handle, and a bucket, and posture sensors may be respectively mounted on the boom, the dipper handle, and the bucket and configured to obtain current actual displacements of the boom, the dipper handle, and the bucket.

A flow rate distribution apparatus provided in this application is described below, reference may be correspondingly made between the flow rate distribution apparatus described below and the flow rate distribution method described above.

Figure 4:
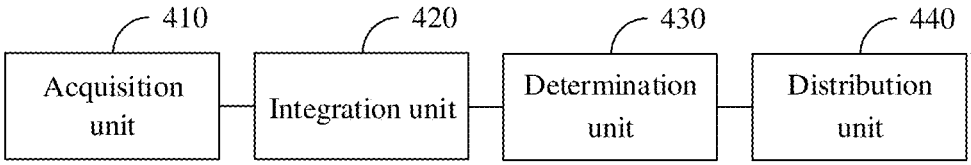
FIG. 4 is a schematic structural diagram of a flow rate distribution apparatus according to an embodiment of this application.

Based on any foregoing embodiment, this application provides a flow rate distribution apparatus. As shown in FIG. 4, the apparatus includes: an acquisition unit 410, configured to obtain a current actual displacement of each working element on a work machine; an integration unit 420, configured to perform time integration on a current speed of each working element to obtain a current target displacement of each working element; a determination unit 430, configured to determine a current displacement deviation of each working element based on the current actual displacement of each working element and the current target displacement of each working element; and a distribution unit 440, configured to distribute a current pump control flow rate of the work machine based on the current displacement deviation of each working element.

Based on any foregoing embodiment, the distribution unit 440 includes: a ratio determination unit, configured to determine a flow rate distribution ratio of each working element based on the current displacement deviation of each working element and an oil cylinder cross-sectional area of each working element; and a flow rate distribution unit, configured to distribute the current pump control flow rate of the work machine based on the flow rate distribution ratio of each working element.

Based on any foregoing embodiment, the ratio determination unit includes: a current flow rate determination unit, configured to determine a current required flow rate of each working element based on the current displacement deviation of each working element and the oil cylinder cross-sectional area of each working element, where the current required flow rate of each working element is used for representing a flow rate required for each working element to reach the current target displacement; and a calculation unit, configured to determine the flow rate distribution ratio of each working element based on the current required flow rate of each working element.

Based on any foregoing embodiment, the apparatus further includes: a speed determination unit, configured to determine the current speed of each working element based on a current lever stroke of the work machine and a preset lever stroke-speed curve of each working element, where the preset lever stroke-speed curve of each working element is used for representing a relationship between a current lever stroke and a current speed of a corresponding working element.

Based on any foregoing embodiment, the apparatus further includes: a monitoring unit, configured to obtain an oil cylinder pressure of each working element in real time in a process of distributing the current pump control flow rate of the work machine, and when an oil cylinder pressure of any working element exceeds a preset pressure range, adjust a valve opening degree corresponding to this working element, until an oil cylinder pressure corresponding thereto becomes within the preset pressure range.

Based on any foregoing embodiment, the current actual displacement of each working element is determined based on a posture parameter acquired by a posture sensor on each working element.

Based on any foregoing embodiment, this application further provides a work machine, including: the flow rate distribution apparatus in any foregoing embodiment. The work machine here may be, for example, a crane, an excavator, a pile driver, or another engineering machine, or may be, for example, a ladder truck, a fire engine, an agitating lorry, or another engineering vehicle.

Figure 5:
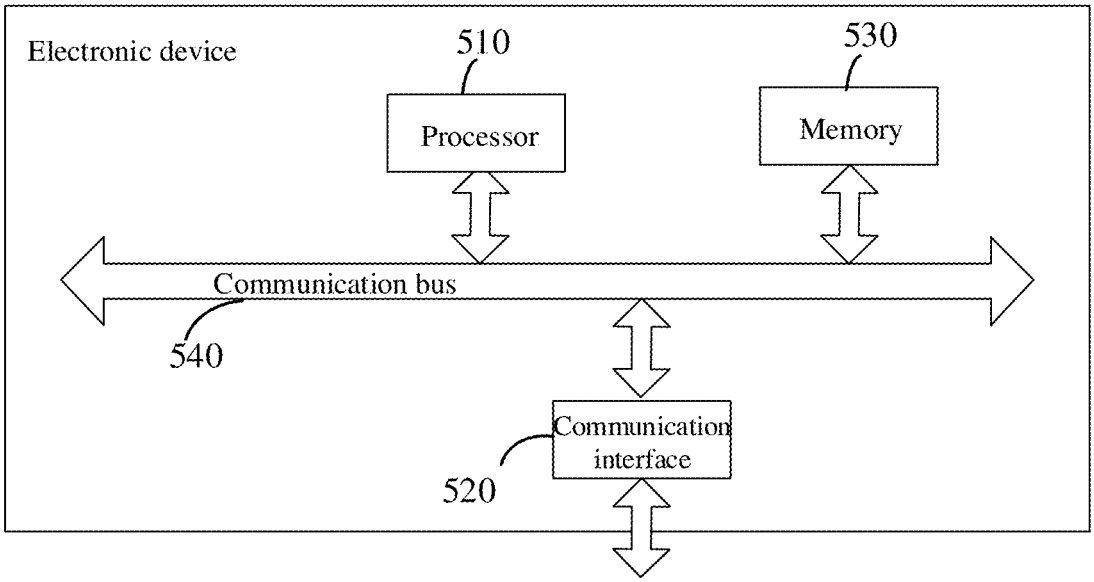
FIG. 5 is a schematic diagram of a structure of an electronic device according to an embodiment of this application.

FIG. 5 is a schematic diagram of a structure of an electronic device according to an embodiment of this application. As shown in FIG. 5, the electronic device may include a processor 510, a communication interface 520, a memory 530, and a communication bus 540. The processor 510, the communication interface 520, and the memory 530 implement communication with each other through the communication bus 540. The processor 510 may invoke logical instructions in the memory 530 to perform the flow rate distribution method. The method includes: acquiring current actual displacements of a plurality of working elements on a work machine; performing time integration on a current speed of each working element to obtain a current target displacement of each working element; determining a current displacement deviation of each working element based on the current actual displacement of each working element and the current target displacement of each working element; and distributing a current pump control flow rate of the work machine based on the current displacement deviation of each working element.

In addition, when the logical instructions in the foregoing memory 530 may be implemented in the form of a software functional unit and sold or used as an independent product, the integrated unit may be stored in a computer-readable storage medium. Based on such an understanding, the technical solutions of this application essentially, or the part contributing to the related art, or some of the technical solutions may be implemented in a form of a software product. The computer software product is stored in a storage medium, and includes several instructions for indicating a computer device (which may be a personal computer, a server, or a network device) to perform all or some of the steps of the methods described in embodiments of this application. The foregoing storage medium includes: any medium that can store program code, such as a USB flash drive, a removable hard disk, a read-only memory (ROM), a random access memory (RAM), a magnetic disk, or an optical disc.

According to another aspect, this application further provides a computer program product. The computer program product includes a computer program stored in a non-transitory computer-readable storage medium, the computer program includes program instructions, and the program instructions, when executed by a computer, enables the computer to perform the flow rate distribution method provided in the foregoing methods. The method includes: acquiring current actual displacements of a plurality of working elements on a work machine; performing time integration on a current speed of each working element to obtain a current target displacement of each working element; determining a current displacement deviation of each working element based on the current actual displacement of each working element and the current target displacement of each working element; and distributing a current pump control flow rate of the work machine based on the current displacement deviation of each working element.

According to still another aspect, this application further provides a non-transitory computer-readable storage medium, having a computer program stored therein, where the computer program, when being executed by a processor, enables the processor to perform the flow rate distribution method provided above. The method includes: acquiring current actual displacements of a plurality of working elements on a work machine; performing time integration on a current speed of each working element to obtain a current target displacement of each working element; determining a current displacement deviation of each working element based on the current actual displacement of each working element and the current target displacement of each working element; and distributing a current pump control flow rate of the work machine based on the current displacement deviation of each working element.

The apparatus embodiments described above are merely examples. The units described as separate parts may or may not be physically separate, and parts displayed as units may or may not be physical units, and may be located at one position, or may be distributed on a plurality of network units. Some or all of the modules may be selected according to actual needs to achieve the objectives of the solutions in the embodiments. A person of ordinary skill in the art can understand and implement the solutions without creative efforts.

Based on the description of the implementations, a person skilled in the art may clearly understand that the implementations may be implemented by using software plus a necessary universal hardware platform, and certainly may be implemented by hardware. Based on such an understanding, the technical solutions essentially, or the part contributing to the related art may be implemented in the form of a software product. The computer software product may be stored in a computer-readable storage medium, for example, a ROM/RAM, a magnetic disk, an optical disc, or the like, and includes several instructions for instructing a computer device (which may be a personal computer, a server, a network device, or the like) to perform the methods in the embodiments of some parts of the embodiments.

Finally, it should be noted that the foregoing embodiments are merely intended for describing the technical solutions of this application, but not for limiting this application. Although this application is described in detail with reference to the foregoing embodiments, a person of ordinary skill in the art should understand that they may still make modifications to the technical solutions described in the foregoing embodiments or make equivalent replacements to some technical features thereof, without departing from the spirit and scope of the technical solutions of embodiments of this application.

What is claimed is:

1. A flow rate distribution method, comprising:

acquiring a current actual displacement of each working element on a work machine;

performing time integration on a current speed of each working element to obtain a current target displacement of each working element;

determining a current displacement deviation of each working element based on the current actual displacement of each working element and the current target displacement of each working element; and distributing a current pump control flow rate of the work machine based on the current displacement deviation of each working element;

wherein the step of distributing a current pump control flow rate of the work machine based on the current displacement deviation of each working element comprises:

determining a flow rate distribution ratio of each working element based on the current displacement deviation of each working element and an oil cylinder cross-sectional area of each working element; and distributing the current pump control flow rate of the work machine based on the flow rate distribution ratio of each working element;

wherein, before performing time integration on a current speed of each working element to obtain a current target displacement of each working element, the method further comprises:

determining the current speed of each working element based on a current lever stroke of the work machine and a preset lever stroke-speed curve of each working element, wherein the preset lever stroke-speed curve of each working element is used for representing a relationship between a current lever stroke and a current speed of a corresponding working element.

2. The flow rate distribution method according to claim 1, wherein the step of determining a flow rate distribution ratio of each working element based on the current displacement deviation of each working element and an oil cylinder cross-sectional area of each working element comprises:

determining a current required flow rate of each working element based on the current displacement deviation of each working element and the oil cylinder cross-sectional area of each working element, wherein the current required flow rate of each working element is used for representing a flow rate required for each working element to reach the current target displacement; and determining the flow rate distribution ratio of each working element based on the current required flow rate of each working element.

3. The flow rate distribution method according to claim 1, wherein the step of distributing the current pump control flow rate of the work machine comprises:

acquiring an oil cylinder pressure of each working element in real time, and when an oil cylinder pressure of any working element exceeds a preset pressure range, adjusting a valve opening degree corresponding to this working element, until an oil cylinder pressure corresponding thereto becomes within the preset pressure range.

4. The flow rate distribution method according to claim 1, wherein the current actual displacement of each working element is determined based on a posture parameter acquired by a posture sensor on each working element.

5. The flow rate distribution method according to claim 1, wherein the current actual displacement of each working element is determined based on an angle change of each working element and a size parameter of each working element.

6. The flow rate distribution method according to claim 1, wherein the step of determining a current displacement deviation of each working element based on the current actual displacement of each working element and the current target displacement of each working element comprises:

calculating a difference value between the current actual displacement of each working element and the current target displacement of each working element to obtain the current displacement deviation of each working element.

7. The flow rate distribution method according to claim 1, wherein the current pump control flow rate of the work machine comprises a maximum flow rate that the work machine is capable of outputting currently.

8. A work machine, comprising a flow rate distribution apparatus, the flow rate distribution apparatus comprises:

an acquisition unit, configured to obtain a current actual displacement of each working element on a work machine;

an integration unit, configured to perform time integration on a current speed of each working element to obtain a current target displacement of each working element;

a determination unit, configured to determine a current displacement deviation of each working element based on the current actual displacement of each working element and the current target displacement of each working element; and a distribution unit, configured to distribute a current pump control flow rate of the work machine based on the current displacement deviation of each working element;

wherein the distribution unit comprises:

a ratio determination unit, configured to determine a flow rate distribution ratio of each working element based on the current displacement deviation of each working element and an oil cylinder cross-sectional area of each working element; and a flow rate distribution unit, configured to distribute the current pump control flow rate of the work machine based on the flow rate distribution ratio of each working element;

wherein the work machine further comprises:

a speed determination unit, configured to determine the current speed of each working element based on a current lever stroke of the work machine and a preset lever stroke-speed curve of each working element, wherein the preset lever stroke-speed curve of each working element is used for representing a relationship between a current lever stroke and a current speed of a corresponding working element.

9. The work machine according to claim 8, wherein the ratio determination unit comprises:

a current flow rate determination unit, configured to determine a current required flow rate of each working element based on the current displacement deviation of each working element and the oil cylinder cross-sectional area of each working element, wherein the current required flow rate of each working element is used for representing a flow rate required for each working element to reach the current target displacement; and a calculation unit, configured to determine the flow rate distribution ratio of each working element based on the current required flow rate of each working element.

10. The work machine according to claim 8, further comprising:

a monitoring unit, configured to obtain an oil cylinder pressure of each working element in real time in a process of distributing the current pump control flow rate of the work machine, and when an oil cylinder pressure of any working element exceeds a preset pressure range, adjust a valve opening degree corresponding to this working element, until an oil cylinder pressure corresponding thereto becomes within the preset pressure range.

11. The work machine according to claim 8, wherein the current actual displacement of each working element is determined based on a posture parameter acquired by a posture sensor on each working element.

12. The work machine according to claim 8, wherein the current actual displacement of each working element is determined based on an angle change of each working element and a size parameter of each working element.

13. An electronic device, comprising: a memory, a processor, and a computer program stored in the memory and configured to be executed by the processor, wherein the processor, when executing the computer program, performs the flow rate distribution method according to claim 1.

14. The electronic device according to claim 13, wherein the step of determining a flow rate distribution ratio of each working element based on the current displacement deviation of each working element and an oil cylinder cross-sectional area of each working element comprises:

determining a current required flow rate of each working element based on the current displacement deviation of each working element and the oil cylinder cross-sectional area of each working element, wherein the current required flow rate of each working element is used for representing a flow rate required for each working element to reach the current target displacement; and determining the flow rate distribution ratio of each working element based on the current required flow rate of each working element.

* * * * *